United States Patent [19]

van't Hooft

[11] 4,233,517

[45] Nov. 11, 1980

[54] APPARATUS FOR INTERNAL IRRADIATION

[76] Inventor: Eric van't Hooft, Dekkershos 7, Leersum, Netherlands

[21] Appl. No.: 969,055

[22] Filed: Dec. 13, 1978

Related U.S. Application Data

[63] Continuation-in-part of Ser. No. 823,864, Aug. 11, 1977, abandoned.

[51] Int. Cl.[2] ..... G21F 5/02

[52] U.S. Cl. ..... 250/497; 250/496

[58] Field of Search ..... 250/496, 497, 515; 176/87, 27, 37, 30

[56] References Cited

U.S. PATENT DOCUMENTS

| | | | |
|---|---|---|---|
| 3,159,748 | 12/1964 | Aikens | 250/497 |
| 3,515,876 | 6/1970 | Smith et al. | 250/497 |
| 4,069,423 | 1/1978 | Garrett | 250/497 |

*Primary Examiner*—Bruce C. Anderson

*Attorney, Agent, or Firm*—Haseltine, Lake & Waters

[57] ABSTRACT

Apparatus for internal irradiation wherein the radioactive material is applied in the shape of a ball row consisting of contiguous radio-active and neutral balls. This ball row is prepared beforehand and is pneumatically transferred to an applicator tube adapted to be introduced into a body cavity. In order that the balls may stay exactly in the right places during the irradiation, the applicator tube is provided with an internal channel having a narrow end portion, passing through a shoulder into the remaining wider portion, and a final ball is added to each ball row, this final ball having a larger diameter than the other balls, so that it is not admitted in the narrow end portion of the internal channel in the applicator tube. Thus, upon introduction of a ball row, the final ball is arrested by the shoulder and keeps the other balls in place. A plurality of applicator tubes may be applied, each of which is associated with an intermediate container in which the ball row is composed. After the irradiation, the ball row is returned through the intermediate container to a sorting device directing the balls to appropriate storage containers. However, the final ball is retained in the intermediate container, so that it may be added to the next ball row to be composed.

8 Claims, 2 Drawing Figures

APPARATUS FOR INTERNAL IRRADIATION

This application is a continuation-in-part of application Ser. No. 823,864, filed Aug. 11, 1977, now abandoned.

BACKGROUND OF THE INVENTION

French patent 1,593,557 discloses an apparatus for internal irradiation, comprising a distributor for composing a ball row out of radio-active and neutral balls, at lease one applicator tube adapted to be introduced into a body cavity to be irradiated, and a pneumatic transport system by which a ball row may be inserted in an applicator tube and removed from the same.

In an apparatus of this kind, the applicator tube may form a part of a Fletcher applicator comprising three applicator tubes adapted to be introduced into a body cavity, and each adapted to receive a radio-active material.

In order that the irradiation may be exactly applied to the required locations, the radio-active material is introduced in the shape of a ball row consisting of contiguous radio-active and neutral balls. Thus, an irradiation occurs at the location of the radio-active balls, and there is no irradiation at the locations of the neutral balls. The ball row is composed beforehand, and is pneumatically transferred to the desired applicator tube. Usually, each ball row contains a fixed number of balls, for instance 48 balls.

The pneumatic pressure moves the ball row so far into the internal channel in the applicator tube that the foremost ball abuts against the end wall of this channel. After termination of the irradiation, the ball row is removed from the applicator tube by a pneumatic pressure in the opposite direction. For this purpose, the applicator tube may be double-walled, so that it consists of an inner casing forming the internal channel receiving the ball row, and an outer casing surrounding the same. The air for removing the ball row from the applicator tube is supplied to the outer casing, which communicates with the internal channel through an opening at the end of the inner casing.

In order that the irradiation is applied to the correct locations, it is, of course, necessary that the balls stay in place during the irradiation. For this purpose, it is usual to maintain the pneumatic pressure used for introducing the balls during the irradiation, so that the ball row is pressed against the end wall of the inner casing of the applicator tube.

It has been found, however, that the balls do not always stay in place in practice, since the air exerting the pneumatic pressure may leak past the balls of the ball row, in particular due to the pressure of the opening in the end wall of the inner casing. This leakage also leads to an excessive air consumption, which may involve a deposition of dirt on the tube walls. In this connection, it is pointed out that the total duration of the irradiation may amount, for certain patients, to more than 40 hours.

SUMMARY OF THE INVENTION

It is the object of the invention to remove the above-mentioned disadvantages, and to provide an apparatus of the indicated kind wherein the balls stay exactly in place during the irradiation, and wherein the air consumption is moderate.

For this purpose, the internal channel in the applicator tube has an end portion with a reduced diameter, passing through a shoulder into the remaining wider portion and having a length corresponding with the length of a ball row, while a final ball is added at the end of each ball row introduced into the applicator tube, this final ball having a larger diameter than the remaining balls, so that the final ball is not admitted by the narrow end portion of the internal channel in the applicator tube, but is arrested by the shoulder, whereby the remaining balls are kept in place.

The apparatus may comprise a first storage container for the neutral balls, and a second storage container for the radio-active balls. These storage containers are connected through associated valves with a distributor used for composing the ball row. This distributor may comprise a series of switching members in the case that the apparatus comprises a plurality of applicator tubes.

After termination of the irradiation, the balls of the returned ball row may be supplied to a sorting device directing each ball to the appropriate storage container. If the neutral balls are made of a magnetic material, such as stainless steel, and the radio-active balls are non-magnetic, a magnetic sorting device may be used.

Each applicator tube may be associated with an intermediate container, in which the ball row is composed and to which it is returned after use, and this intermediate container is connected with the sorting device through return conduit means comprising a retaining means having a passage of which the diameter is so small that the final ball is not admitted, so that the final ball stays in the intermediate container. Thus, in the interval between two irradiations to be executed by an applicator tube, the intermediate container associated with the applicator tube always holds a final ball, which will be added to a ball row composed in this intermediate container.

In order to maintain the correct positions of the balls, it is, of course, necessary that the final ball is firmly kept against the shoulder. In order to check this condition, it is preferred that a pressure switch is in communication with the wider portion of the internal chamber in the applicator tube, so as to establish whether the pneumatic pressure is sufficient to hold the final ball pressed against the shoulder.

DESCRIPTION OF A PREFERRED EMBODIMENT

Figure 1:
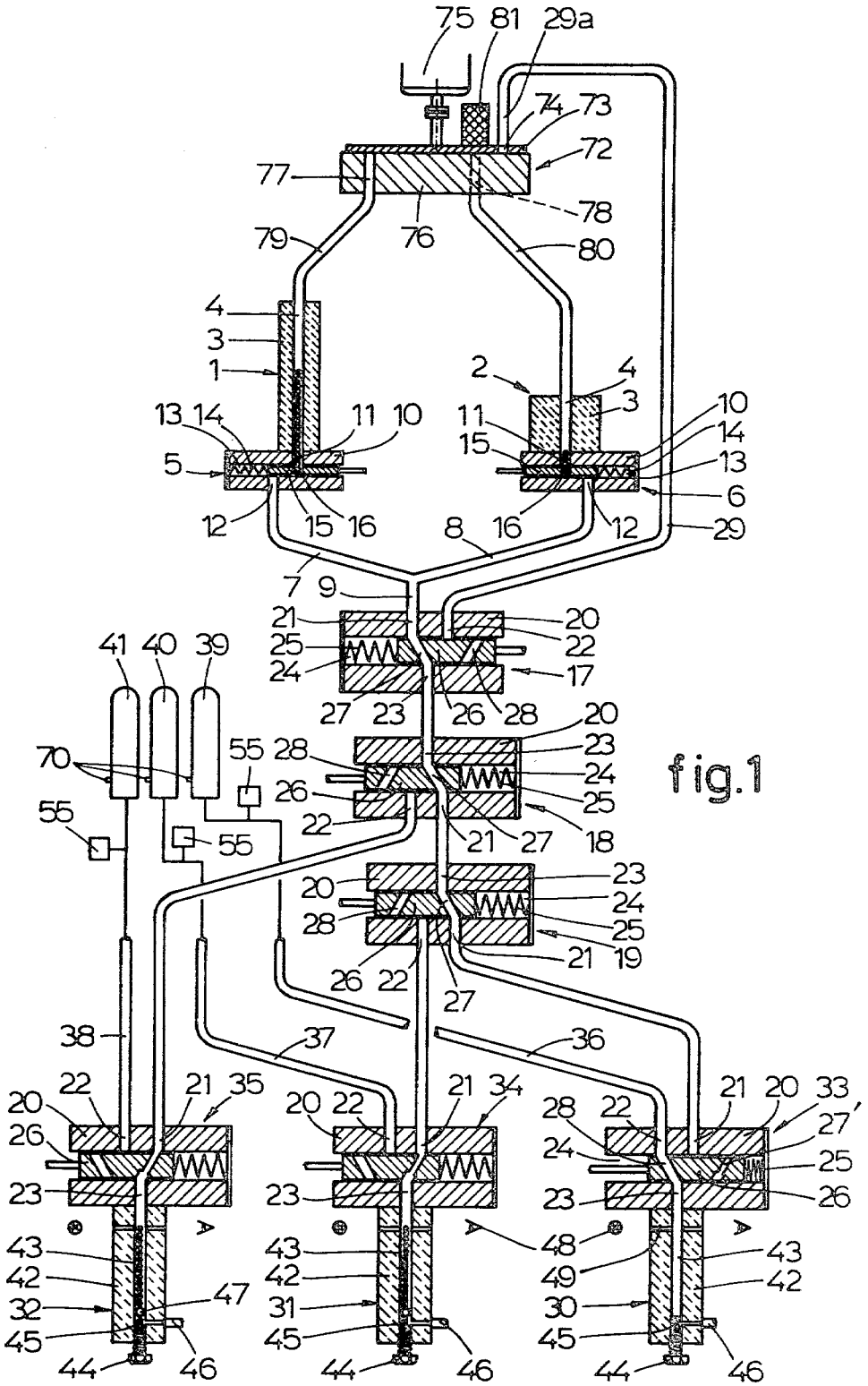
FIG. 1 schematically shows an embodiment of an apparatus for internal irradiation according to the invention.

FIG. 1 shows a first storage container 1 for neutral balls and a second storage container 2 for radio-active balls. Each of these containers 1, 2 consists of an upstanding cylindrical housing 3 having a central bore 4, wherein the relative balls may be received. The housing 3 of the storage container 2 for the radio-active balls has a wall thickness which is considerably larger than the wall thickness of the housing 3 of the storage container 1 for the neutral balls, while the height of the housing 3 of the storage container 2 is smaller than the height of the housing 3 of the storage container 1.

The storage containers 1 and 2 respectively are each connected through an associated valve 5 and 6 respectively and conduits 7 and 8 respectively to a common vertical supply line 9.

Each valve 5 or 6 comprises a housing 10 with an upper vertical inlet channel 11 connected to the bore 4 of the associated storage container 1 or 2 and a lower vertical outlet channel 12, which is offset with respect to the inlet channel 11 and which is connected to the associated conduit 7 or 8.

Each housing 10 has a lateral opening 13, wherein a slide 15 is slidably mounted, which may be reciprocated horizontally by an actuating means such as a pneumatic cylinder-piston assembly or the like. The slide 15 is biased by a compression spring 14 and may be displaced between a first position (shown in FIG. 1), wherein a vertical bore 16 in this slide 15 connects to the inlet channel 11 and a second position, wherein this bore 16 connects to the outlet channel 12. The bore 16 in the slide 15 can only contain one ball at a time. When the slide 15 is actuated and is displaced from the position shown in FIG. 1 against the pressure of the spring 14 to its second position one ball is taken along, which thereafter falls under the influence of gravity through the outlet channel 12 of the valve 5 or 6 and through the conduit 7 or 8 into the supply line 9.

When the slide 15 is displaced from its position shown in FIG. 1 to its other position the balls in the storage container 1 or 2 in question rest on this slide 15. After the slide 15 is returned into the position shown in FIG. 1 the lowermost ball enters the bore 16 in the slide 15 by gravity, whilst the overlying balls in the storage container 1 or 2 are displaced downwardly over the height of one ball.

The supply line 9 is connected to a distributor means, which comprises a plurality of switching members, in the embodiment shown three switching members 17, 18 and 19. The switching members 17, 18 and 19 each comprise a housing 20, wherein at one side (with the switching member 17 at the upper side and with the switching members 18 and 19 at the lower side) two vertical ports 21 and 22 are formed, whilst at the other side (with the switching member 17 at the lower side and with the switching members 18 and 19 at the upper side) one vertical port 23 is formed.

Each housing 20 has a lateral opening 24, wherein a slide 26 is slidably mounted, which may be reciprocated horizontally by an actuating means such as a pneumatic cylinder-piston assembly or the like. The slide 26 is biased by a compression spring 25 and may be displaced between a first position, wherein the ports 21 and 23 are connected with each other and a second position, wherein the ports 22 and 23 are connected with each other. For this purpose two inclined bores 27 and 28 respectively are formed in the slide 26.

In FIG. 1 the switching member 17 is shown in the supply position, wherein the port 21 is in open communication with the port 23 through the inclined bore 27 in the slide 26, so that balls which fall downwardly in the supply line 9 will freely pass the switching member 17. In the other position of the slide 26 of the switching member 17 the port 23 is connected to a return conduit 29 through the inclined bore 28 in the slide 26 and the port 22. The purpose of this return conduit 29 will be further elucidated hereinafter.

The balls which pass through the switching member 17 will thereafter pass the switching members 18 and 19 and will be fed in dependence of the position of these switching members 18 and 19 to one of three intermediate containers 30, 31 and 32. These intermediate containers 30, 31 and 32 are each provided with a switching member 33, 34 and 35 respectively, which is passed by each ball before entering the associated intermediate container 30, 31 or 32.

These switching members 33, 34 and 35 show much resemblance with the switching members 17, 18 and 19. The switching members 33, 34 and 35 each have a housing 20, wherein two vertical ports 21 and 22 are formed at the upper side, whilst one vertical port 23 is formed at the lower side. Each housing 20 has a lateral opening 24, wherein a slide 26 is slidably mounted, which may be reciprocated horizontally by an actuating means such as a pneumatic cylinder-piston assembly or the like. The slide 26 is biased by a compression spring 25 and may be displaced between two positions. In the first position of the slide 26 the ports 21 and 23 are connected to each other, whilst in the second position of the slide 26 the ports 22 and 23 are interconnected. For this purpose two inclined bores 27′ and 28 are formed in the slide 26. The inclined bore 27′ has a shape which differs from that of the bore 27 of the switching members 17, 18 and 19, as will be further explained hereinafter.

In the position of the slide 26 of the switching member 33, 34 or 35, wherein the ports 21 and 23 are connected with each other the distributor means is interconnected with the intermediate container 30, 31 or 32 cooperating with the relative switching member 33, 34 or 35. In dependence of the position of the switching members 18 and 19 hereafter balls may be fed from the supply line 9 to the relative intermediate container 30, 31 or 32. On the other hand, when the switching member 17 is changed over from its position shown in FIG. 1 into its other position balls may be returned from the intermediate container 30, 31 or 32 to the return conduit 29.

In the other position of the slide 26 of the switching member 33, 34 or 35 the ports 22 and 23 are interconnected, and the relative intermediate container 30, 31 or 32 is connected through a conduit 36, 37 or 38 to an associated applicator tube 39, 40 or 41.

In FIG. 1 both switching members 18 and 19 are shown in the position, wherein the balls may be fed from the supply line 9 to the switching member 33 of the intermediate container 30. When the switching member 18 is changed over the supply line 9 is connected to the intermediate container 32. In the case that the switching member 18 maintains its position shown in FIG. 1 and the switching member 19 is changed over, the supply line 9 is connected with the intermediate container 31.

Each intermediate container 30, 31 or 32 consists of an upstanding housing 42, wherein a central bore 43 is formed which is connected with the lower port 23 in the housing 20 of the relative switching member 33, 34 or 35. The bore 43 in the housing 42 of each intermediate container 30, 31 or 32 is closed at the lower end by means of a set screw 44, which carries a thin pin 45 at the upper side. In the vicinity of this thin pin 45 a supply channel 46 for air under pressure debouches into the bore 43.

The ball row for each applicator tube 39, 40 or 41 is composed in the cooperating intermediate container 30, 31 or 32. For this purpose the switching members 17, 18, 19 and 33, 34 or 35 are brought in such position that the supply line 9 is connected to the intermediate container 30, 31 or 32 in question, wherein the ball row has to be composed. Hereafter the valves 5, 6 are opened and closed according to a predetermined program, whereby radio-active and neutral balls are supplied to this intermediate container 30, 31 or 32 in the desired sequence. The ball row composed in this manner may for example contain 48 balls each having a diameter of 2½ mm.

Each intermediate container 30, 31 and 32 initially contains a final ball 47, which rests on the pin 45 of the set screw 44 and which is added to the composed ball row. This final ball 47 is a neutral ball having a diameter which is larger than the diameter of the other balls and which for example amounts to 3.0 mm. Therefore, the smaller balls come to rest on this lower final ball 47 in the intermediate container 30, 31 or 32 in question.

A sensing means 48 comprising a radio-active cell may sense through a lateral channel 49 in the housing 42 of the intermediate container 30, 31 or 32 whether the required number of balls is supplied indeed into the intermediate container 30, 31 or 32, wherein the row of balls has to be composed.

As soon as the ball row has been completed the switching member 33, 34 or 35 of the intermediate container 30, 31 or 32 in question is changed over, so that this intermediate container is connected with the conduit 36, 37 or 38 leading to the associated applicator tube 39, 40 or 41. Hereafter air under pressure is supplied to the supply channel 46 in question, whereby the ball row together with the final ball 47 is transferred to the associated applicator tube 39, 40 or 41 through the port 23, the inclined bore 28 in the slide 26, and the port 22 of the associated switching member 33, 34 or 35, and through the conduit 36, 37 or 38 connected thereto.

Figure 2:
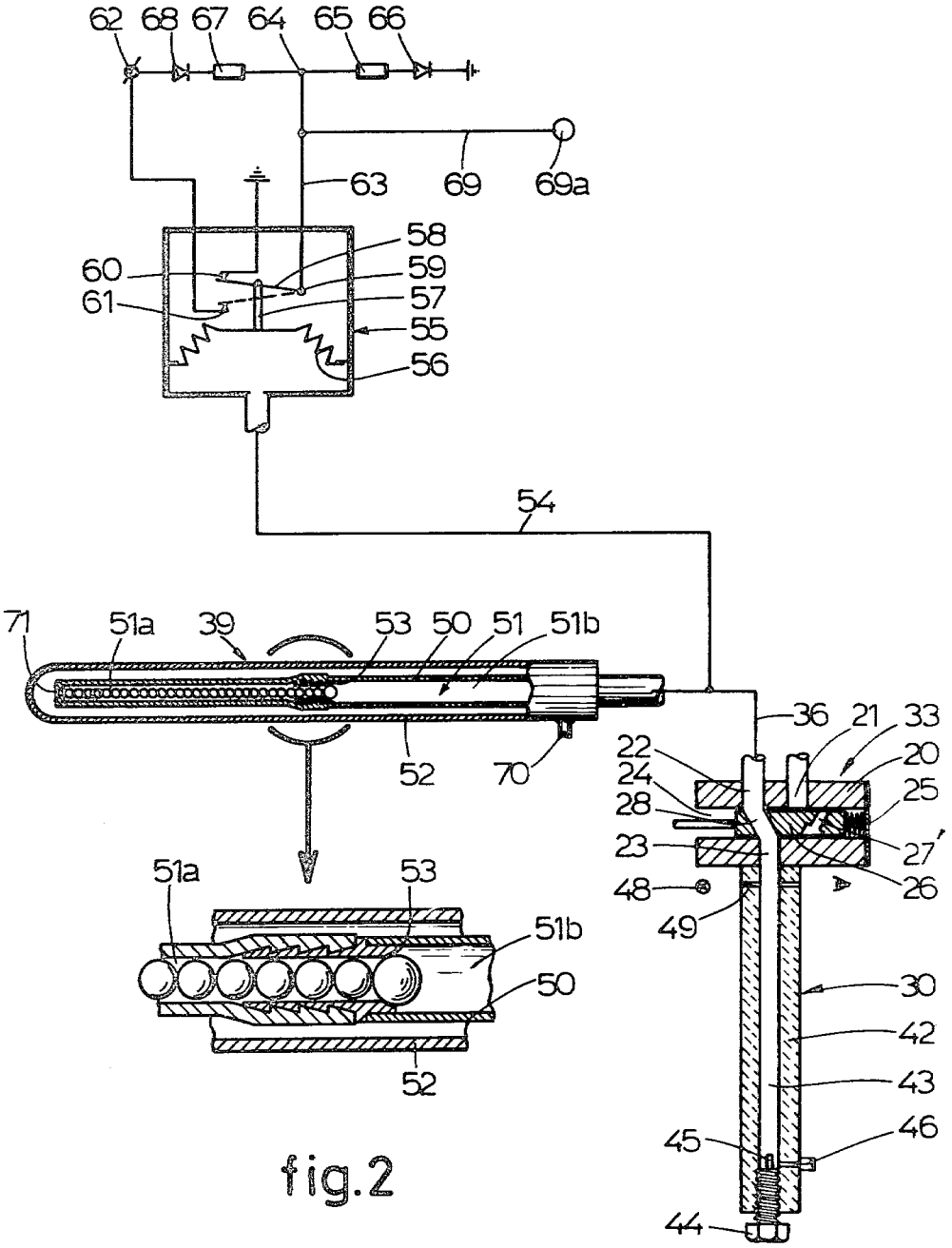
FIG. 2 is a longitudinal section of an applicator tube with its connections to an associated intermediate container and to a pressure switch, a portion of the applicator tube being separately shown at a larger scale.

The applicator tubes 39, 40 and 41 are all built in the same manner. In FIG. 2 the applicator tube 39 is shown, which has a double-walled construction and which consists of an inner casing 50, wherein an internal channel 51 is formed and an outer casing 52. The ball row is introduced into the internal channel 51, in such manner that the foremost ball abuts against the end of the inner casing 50. The internal channel 51 has an end portion **51*a* with a reduced diameter, of which the length corresponds with that of a ball row, e.g. of 48 balls. The end portion 51*a* passes through a shoulder 53 into the remaining wider portion 51*b* in the inner channel 51**.

Upon introduction of a ball row into an applicator tube 39, 40 or 41 the final ball 47 is arrested by the shoulder 53, since its diameter is so large that it cannot enter the narrow end portion **51*a* of the internal channel 51. Thus, the balls with a smaller diameter are closed up by the final ball 47**, whereby they are exactly kept in the right place.

A pressure switch 55 is connected to each of the conduits 36, 37 and 38 through a branch conduit 54, in order to be able to check whether the balls remain in their correct position within the narrow end portion **51*a* of the internal channel 51. This pressure switch 55 comprises a membrane 56, which actuates a switch arm 58 through an actuating arm 57. This switch arm 58 is pivotally connected with a contact 59 and may be switched over between two further contacts 60, 61. The contact 60 is connected to earth, whilst the contact 61 is connected to a power supply 62. A line 63 leads from the contact 59 to a point of junction 64. A circuit comprising a current limiting resistance 65 and a red alarm lamp 66 executed as LED extends between the point of junction 64 and earth. A second circuit consisting of a current limiting resistance 67 and a green lamp 68 executed as LED extends between the point of junction 64 and the power supply 62. A branch line 69 is connected to the line 63 and leads to an alarm bell 69*a*** or the like.

In the situation as shown in FIG. 2 sufficient overpressure prevails in the portion **51*b* of the internal channel 51 of the applicator tube 39, so that the membrane 56 through the actuating arm 57 maintains the switching arm 58 in the position, wherein the contacts 59 and 60 are connected to each other. Therefore the green lamp 68 is lit, while the red alarm lamp 66 and the alarm bell 69*a*** are inoperative.

When the pressure in the portion **51*b* of the internal channel 51 of the applicator tube 39 would diminish and would become too low, for example due to a leakage or the like, the membrane 56 will switch over the switch arm 58 through the actuating arm 57, so that the contacts 59 and 61 are connected to each other. This will result in that the green lamp 68 is switched off, while the red alarm lamp 66, as well as the alarm bell 69*a*** are switched on.

The space between the inner casing 50 and the outer casing 52 of each of the applicator tubes 39, 40, 41 is connected to a supply channel 70 for air under pressure, which may also be connected to the atmosphere. After termination of the irradiation this supply channel 70 associated with the applicator tube 39, which was open to the atmosphere during the time that the supply channel 46 of the intermediate container 30 is fed with air under pressure, is supplied with air under pressure, while the supply channel 46 associated with the intermediate container 30 is no longer fed with air under pressure but is connected to the atmosphere. The air under pressure reaches the internal channel 51 through an opening 71 in the end face of the inner casing 50, so that the whole ball row is returned through the conduit 36 and the switching member 33 to the associated intermediate container 30.

Hereafter the switching members 33, 19, 18 and 17 are positioned in such manner that the intermediate container 30 is connected to the return conduit 29, which leads to a sorting device 72. At this stage the inclined bore 27' in the slide 26 of the switching member 33 has come in the operative position. This bore 27' has such a diameter that the balls of the ball row may pass, but the final ball 47, which has a larger diameter than the other balls, is arrested. Thus this final ball 47 remains in the intermediate container 30 when the ball row is returned by means of air under pressure, which is again fed to the supply channel 46.

The sorting device 72 is a magnetic sorting device, based on the fact that the neutral balls are made of a magnetic material, such as stainless steel and the radioactive balls are non-magnetic.

The sorting device 72 consists of a round plate 73 provided with a bore 74. This round plate 73 is driven by an electric motor 75 and extends immediately above a housing 76, wherein two bores 77 and 78 are formed, which are connected to return conduits 79 and 80 respectively, which lead to the storage containers 1 and 2 respectively.

During a rotation of the round plate 73 the bore 74 in the round plate 73 will become aligned for a short period of time with the lower open end of the vertical end portion **29*a* of the return conduit 29. During this short period of time a returned ball may enter the bore 74. The height of the bore 74 is such that only one ball may be received in the bore 74** at the same time. Hereafter the bores 78 and 77 in the housing 76 of the sorting device 72 are subsequently aligned with the bore 74 in the plate 73 for short periods of time. A permanent magnet 81 is provided immediately above the plate 73 in alignment with the bore 78 in the housing 76. At the moment that the bore 74 in the plate 73 is aligned with the bore 78 in the housing 76 and this bore 74 contains a radio-active ball, this ball will fall down through the bore 78 and will be returned through the return conduit 80 to the storage container 2. If, however, a neutral ball is present in the bore 74, this ball will be attracted by the permanent magnet 81 and will thus be prevented to fall out of the bore 74 in the plate 73 when passing the bore 78 in the housing 76. Therefore, these neutral balls will be taken along by the plate 73 and will fall down by gravity through the bore 77 in the housing 76 into the return conduit 79, which leads to the storage container 1 for the neutral balls. The motor 75 will only be switched on when a ball row is returned from an intermediate container 30, 31 or 32 to the return channel 29.

The cooperation between the applicator tube 39 and the associated intermediate container 30 as described hereinabove wholly corresponds with the cooperation between the applicator tubes 40 and 41 with their associated intermediate containers 31 and 32. The supply of balls to the intermediate containers 31 and 32, as well as the removal of balls from the intermediate containers 31 and 32 also happens fully in the manner described hereinabove with respect to the intermediate container 30.

The invention is not restricted to the embodiment shown in the drawings by way of example, which may be varied in several ways within the scope of the appended claims.

I claim:

1. Apparatus for internal irradiation, comprising a plurality of neutral balls, a plurality of radioactive balls, said neutral balls having the same diameter as said radio-active balls, a distributor for composing a contiguous ball row out of the said neutral and radio-active balls, an applicator tube adapted to be introduced into a body cavity and provided with an internal channel having a narrow end portion parssing through a shoulder into the remaining wider portion of said internal channel, said narrow end portion having substantially the same length as said ball row and being adapted to admit the same, a final ball having a larger diameter than the said radio-active and neutral balls, so that it is not admitted by said narrow end portion, intermediate container means in said distributor for adding said final ball to said ball row at the end thereof, pneumatic means for transferring said ball row and said added final ball from said intermediate container means to said applicator tube in such manner that said added final ball is arrested by the shoulder and is pressed against said shoulder so as to keep the balls of said ball row in the right places during the irradiation, said pneumatic means being further used to return said ball row and said final ball to said intermediate container means after the termination of the irradiation, an adjustable pressure switch connected to the wider portion of said applicator tube, said pressure switch determining whether pneumatic pressure is sufficient to keep the associated final ball pressed against the associated shoulder.

2. Apparatus for internal irradiation, comprising a plurality of neutral balls, a plurality of radioactive balls, a first storage container for said neutral balls, a second storage container for said radio-active balls, said neutral balls having the same diameter as said radio-active balls, valve means connecting each of said storage containers with a distributor for composing a contiguous ball row out of the said neutral and radio-active balls, an applicator tube adapted to be introduced into a body cavity and provided with an internal channel having a narrow end portion passing through a shoulder into the remaining wider portion of said internal channel, said narrow end portion having substantially the same length as said ball row and being adapted to admit the same, a final ball having a larger diameter than the said radio-active and neutral balls, so that it is not admitted to said narrow end portion, intermediate container means in said distributor for adding said final ball to said ball row at the end thereof, pneumatic means for transferring said ball row and said added final ball from said intermediate container means to said applicator tube in such manner that said added final ball is arrested by the shoulder and is pressed against said shoulder so as to keep the balls of said ball row in the right places during the irradiation, said pneumatic means being further used to return said ball row and said final ball to said intermediate container means after the termination of the irradiation and to return the balls of said ball row to their storage containers, an adjustable pressure switch connected to the wider portion of said applicator tube, said pressure switch determining whether pneumatic pressure is sufficient to keep the associated final ball pressed against the associated shoulder.

3. Apparatus according to claim 2, wherein said pressure switch is in communication with the wider portion of said internal channel in the applicator tube, alarm means cooperating with said pressure switch.

4. Apparatus for internal irradiation, comprising a plurality of neutral balls, a plurality of radioactive balls, said neutral balls having the same diameter as said radio-active balls, a distributor for composing contiguous ball rows out of the said neutral and radio-active balls, a plurality of applicator tubes each adapted to be introduced into a body cavity and each provided with an internal channel having a narrow end portion passing through a shoulder into the remaining wider portion of said internal channel, said narrow end portion having substantially the same length as the said ball rows and being adapted to admit the same, a plurality of final balls having a larger diameter than the said radio-active and neutral balls, so that they are not admitted by the said narrow end portions, intermediate container means in said distributor for adding one of the said final balls to each of the said ball rows at the end thereof, pneumatic means for transferring each of the said ball rows and the added final ball from said intermediate container means to one of said applicator tubes in such manner that the added final ball is arrested by the shoulder and is pressed against said shoulder so as to keep the balls of the associated ball row in the right places during the irradiation, said pneumatic means being further used to return each ball row and the added final ball to said intermediate container means after the termination of the irradiation, an adjustable pressure switch connected to the wider portion of said applicator tube, said pressure switch determining whether pneumatic pressure is sufficient to keep the associated final ball pressed against the associated shoulder.

5. Apparatus for internal irradiation, comprising a plurality of neutral balls, a plurality of radio-active balls, a first storage container for said neutral balls, a second storage container for said radio-active balls, said neutral balls having the same diameter as said radioactive balls, valve means connecting each of said storage containers with a distributor for composing contiguous ball rows out of the said neutral and radio-active balls, a plurality of applicator tubes each adapted to be introduced into a body cavity and each provided with an internal channel having a narrow end portion passing through a shoulder into the remaining wider portion of said internal channel, said narrow end portion having substantially the same length as the said ball rows and being adapted to admit the same, a plurality of final balls having a larger diameter than the said radio-active and neutral balls, so that they are not admitted by the said narrow end portions, intermediate container means in said distributor for adding one of the said final balls to each of the said ball rows at the end thereof, pneumatic means for transferring each of the said ball rows and the added final ball from said intermediate container means to one of said applicator tubes in such manner that the added final ball is arrested by the shoulder and is pressed against said shoulder so as to keep the balls of the associated ball row in the right places during the irradiation, said pneumatic means being further used to return each ball row and the added final ball to said intermediate container means after the termination of the irradiation and to return the balls of each ball row to their storage containers, an adjustable pressure switch connected to the wider portion of said applicator tube, said pressure switch determining whether pneumatic pressure is sufficient to keep the associated final ball pressed against the associated shoulder.

6. Apparatus as claimed in claim 5, further comprising a sorting device directing the balls of each returned ball row to the appropriate storage containers, a plurality of intermediate containers in said distributor, each associated with one of the said applicator tubes, the said ball rows being composed in the said intermediate containers and returned thereto after use, return conduit means connecting each of the said intermediate containers with said sorting device and retaining means in said return conduit means having a passage of which the diameter is such that the balls of a ball row can pass but the final ball is arrested, so tht each of the said final balls is retained after use in the associated intermediate container.

7. Apparatus according to claim 5, wherein a pressure switch is in communication with the wider portion of the internal channel in each of said applicator tubes, an alarm means cooperating with each of said pressure switches.

8. Apparatus according to claim 6, wherein said sorting device comprises a horizontal plate member which is provided with a bore and which is rotatably supported and connected with an electric motor, said plate member extending above a housing wherein two further bores are formed, each of said further bores being periodically aligned with said bore in said plate member, the first one of said further bores being connected to said storage container for radioactive balls, the second one of said further bores being connected to said storage container for neutral balls, an end conduit portion of said return conduit means debouching above said plate member and being periodically aligned with said bore in said plate member so as to deliver one ball into said bore, and magnetic means above said plate member in alignment with said first one of said further bores.

* * * * *